US010338533B2

(12) United States Patent
Ferri et al.

(10) Patent No.: US 10,338,533 B2
(45) Date of Patent: Jul. 2, 2019

(54) WRISTWATCH COMPRISING A DIAL WITH LUMINOUS INDICES

(71) Applicant: Omega S.A., Biel/Bienne (CH)

(72) Inventors: Yvan Ferri, Lausanne (CH); Rocco Catanese, Bienne (CH); Pierpasquale Tortora, Neuchatel (CH); Gregory Kissling, Macolin (CH)

(73) Assignee: Omega S.A., Biel/Bienne (CH)

( * ) Notice: Subject to any disclaimer, the term of this patent is extended or adjusted under 35 U.S.C. 154(b) by 0 days.

(21) Appl. No.: 15/557,961

(22) PCT Filed: Feb. 23, 2016

(86) PCT No.: PCT/EP2016/053757
§ 371 (c)(1),
(2) Date: Sep. 13, 2017

(87) PCT Pub. No.: WO2016/146350
PCT Pub. Date: Sep. 22, 2016

(65) Prior Publication Data

US 2018/0052426 A1 Feb. 22, 2018

(30) Foreign Application Priority Data

Mar. 17, 2015 (EP) ..... 15159460

(51) Int. Cl.
*G04B 19/30* (2006.01)
*G04B 19/28* (2006.01)

(52) U.S. Cl.
CPC ..... *G04B 19/30* (2013.01); *G04B 19/283* (2013.01)

(58) Field of Classification Search
CPC ..... G04B 19/30
See application file for complete search history.

(56) References Cited

U.S. PATENT DOCUMENTS 4,087,960 A * 5/1978 Koichi ..... G04C 10/02 136/244
4,244,044 A 1/1981 Olsson
(Continued)

FOREIGN PATENT DOCUMENTS

CH 687 285 A3 5/1997
CH 687 285 B5 5/1997
(Continued)

OTHER PUBLICATIONS

Machine Translation of EP 2264554.*
International Search Report dated Apr. 8, 2016 in PCT/EP2016/053757 filed Feb. 23, 2016.

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A wristwatch including a watch case, a bezel mounted to rotate on the watch case, and a dial including at least one luminous index. The luminous index is illuminated through the dial by at least one light source disposed underneath the dial and powered by an electrical energy source. An activation component for activating the light source is housed inside the rotating dial and cooperates with a detection element housed inside the watch case. The activation component, in a determined position of the rotating bezel, detects presence of the activation component by the detection element. The detection element then emits an electrical signal addressed to a microprocessor circuit housed inside the watch case. The microprocessor circuit emits in response to reception of the electrical signal emitted by the detection element an electrical signal that activates lighting of the light source for a determined period of time.

17 Claims, 10 Drawing Sheets

(56) References Cited

U.S. PATENT DOCUMENTS

| | | | | |
|---|---|---|---|---|
| 2002/0101457 | A1* | 8/2002 | Lang | G06F 1/163 715/856 |
| 2009/0109650 | A1 | 4/2009 | Winkler | |
| 2009/0109651 | A1 | 4/2009 | Winkler | |
| 2009/0109801 | A1 | 4/2009 | Winkler | |
| 2010/0202255 | A1* | 8/2010 | Klopfenstein | G04G 9/0041 368/226 |
| 2011/0280110 | A1* | 11/2011 | Chen | G04B 19/30 368/67 |

FOREIGN PATENT DOCUMENTS

| | | | |
|---|---|---|---|
| CH | 701 750 | A2 | 3/2011 |
| CH | 707 057 | A2 | 4/2014 |
| EP | 1 666 992 | A1 | 6/2006 |
| EP | 2 264 554 | A1 | 12/2010 |

* cited by examiner

WRISTWATCH COMPRISING A DIAL WITH LUMINOUS INDICES

CROSS-REFERENCE TO RELATED APPLICATIONS

This is a National phase application in the United States of International patent application PCT/EP2016/053757 filed Feb. 23, 2016 which claims priority on European patent application 15159460.3 filed Mar. 17, 2015. The entire disclosures of the above patent applications are hereby incorporated herein by reference.

FIELD OF THE INVENTION

The present invention concerns a wristwatch comprising a dial provided with luminous indices. More specifically, the invention concerns a wristwatch enabling information located on the dial to be read in the dark as well as in daylight.

BACKGROUND OF THE INVENTION

Timepieces of the wristwatch type allowing the user to read the time in the dark are already known. Amongst all these wristwatches, many comprise a dial, typically made of brass, in which are arranged recesses that form the time indices, for example representing the hours. These recesses are then filled by means of a syringe for delivering a phosphorescent material capable of returning at night the luminous energy that the phosphorescent material stored during the day. A phosphorescent material commonly used in high-end watchmaking is marketed by the Japanese company Nemoto & Co. under the brand name Super-LumiNova. This is a strontium aluminate-based non-toxic and non-radioactive material which has advantageously replaced radium-based luminescent paints. However, because the use of Super-LumiNova© material has become widespread in the watchmaking industry, the appearance of watches when they are viewed at night has become greatly standardised, making it difficult to distinguish between a given manufacturer's watch and a competitor's watch. All watch manufacturers strive to give their products a strong visual identity that sets them apart from competitors' watches.

Further, in wristwatches equipped with a light source, activation of the light source is usually achieved by means of a push-button located at a given place on the periphery of the watch case and which is therefore difficult to find when the user is fumbling in the dark.

SUMMARY OF THE INVENTION

It is an object of the present invention to overcome the aforementioned problems, in addition to others, by providing a timepiece comprising a dial provided with luminous indices which confer on the timepiece thus equipped an easily identifiable appearance when the timepiece is consulted both in the dark and in daylight.

To this end, the present invention concerns a wristwatch comprising a watch case, a bezel mounted to rotate on the watch case and a dial provided with at least one luminous index, this luminous index being illuminated through the dial by at least one light source disposed underneath the dial and powered by an electrical energy source, a component for activating the light source being housed inside the rotating bezel and cooperating with a detection component housed inside the watch case, the activation component being arranged such that, in a determined position of the rotating bezel, its presence is detected by the detection component, the detection component then emitting an electrical signal which controls the lighting of the light source.

As a result of these features, the present invention provides a wristwatch in which at least one luminous index making it possible to read information located on the dial, both in the dark and in daylight, for example a time index, is illuminated on demand by the user by lighting a light source placed underneath the dial. In order to activate the lighting of the light source, the user needs simply to pivot the rotating bezel and bring it into a predetermined position in which the presence of an activation component housed inside the rotating bezel is detected by a detection component which, in response, activates the light source. There is thus obtained a wristwatch wherein the dial is provided with hour symbols that can be illuminated on demand by means of one or more light sources, which confers on a wristwatch according to the invention, when consulted at night by its user, a unique appearance which cannot be confused with the appearance of another wristwatch. Providing an activation component inside the wristwatch bezel and a corresponding detection component inside the watch case makes it possible to light the light source on demand, since it goes without saying that is not possible to envisage leaving the light source permanently illuminated, both for reasons of the autonomy of the electrical energy source and for aesthetic reasons. Further, it is very easy to activate the lighting of the light source by means of a rotating bezel. Indeed, it is easier for the user to find the bezel by fumbling in the dark and rotate the latter until the light source is illuminated, than to have to detect the presence, for example, of a small push-button at a location on the watch case and then press the latter to switch on the light source.

BRIEF DESCRIPTION OF THE DRAWINGS

Other features and advantages of the present invention will appear more clearly from the following detailed description of one embodiment of a wristwatch according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea which consists in illuminating one or more indices, for example hour symbols, and/or one or more logos arranged on the surface of a dial by means of one or more light sources disposed underneath the dial and the lighting of which is controlled by means of a bezel mounted to rotate on the watch case. By using light sources, rather than luminescent material, to illuminate the hour symbols of a watch both in the dark and in daylight, the present invention allows the visual appearance of a watch to be significantly differentiated from the appearance of competitors' watches when such watches are consulted by the user. Moreover, using a rotating bezel, which simply needs to be brought into a predetermined position to activate the lighting of the light source or sources, considerably simplifies the task of the user, who is no longer required to fumble in the dark for a small push-button disposed somewhere on the periphery of the watch in order to illuminate the watch dial.

Figure 1:
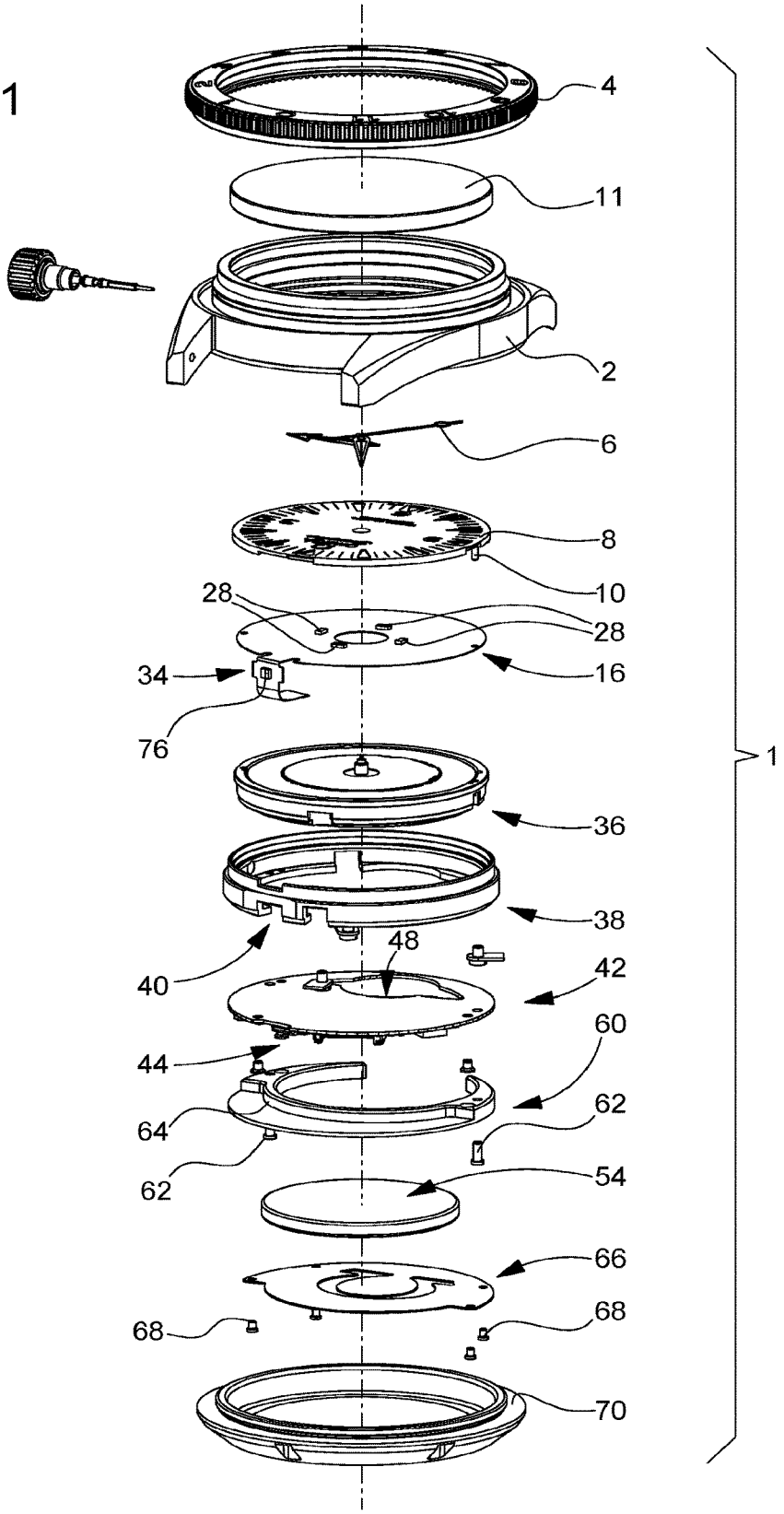
FIG. 1 is a perspective exploded view of a wristwatch case according to the present invention.

As revealed by an examination of FIG. 1, the wristwatch case according to the invention, designated as a whole by the general reference numeral 1, includes a case middle 2 on top of which is mounted a rotating bezel 4. A set of hands 6 for the hours, minutes and seconds moves above a dial 8 provided with dial-feet 10 and covered by a crystal 11.

Figure 2:
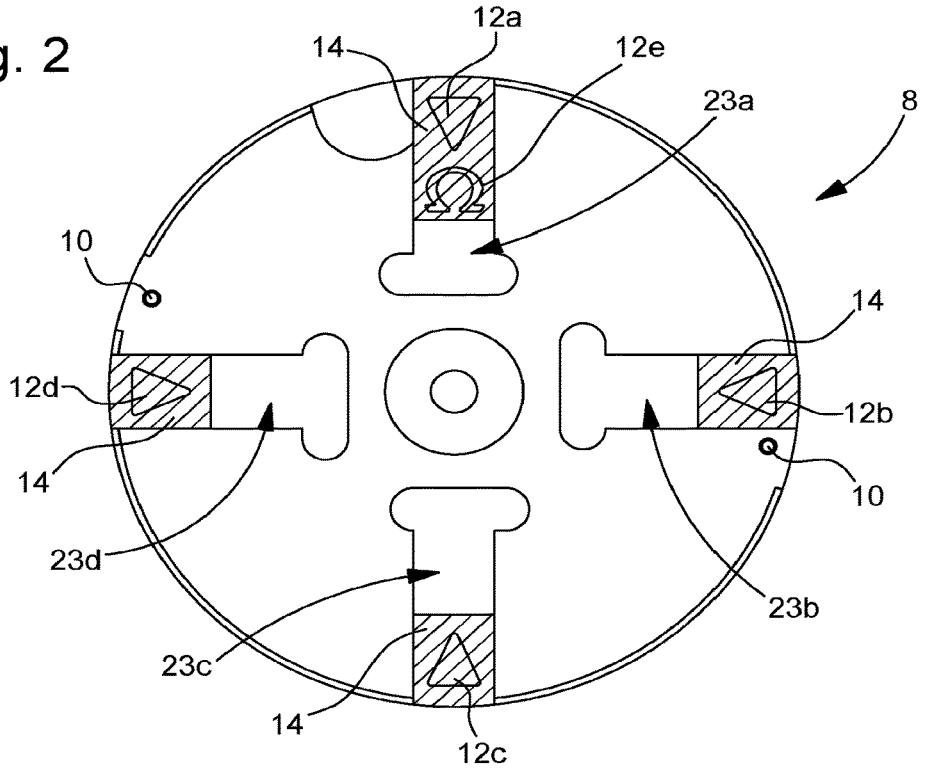
FIG. 2 is a bottom view of the dial of the wristwatch of FIG. 1.

Dial 8 includes at least one and, in the example illustrated in particular in FIG. 2, four indices 12*a*, 12*b*, 12*c* and 12*d* arranged at midday, 3 o'clock, 6 o'clock and 9 o'clock. These four indices 12*a*-12*d* are formed, purely by way of illustration, by four isosceles triangles located equidistant from the edge of dial 8 and whose apexes point towards the centre of dial 8. A fifth index, referenced 12*e*, corresponds, for example, to the commercial logo Ω of the Applicant. This fifth index 12*e* is placed underneath the first index 12*a*, at a short distance from the centre of dial 8. It will be understood that this is simply a design choice and that the present invention is not limited by the number, shape or position of indices 12*a*-12*e*.

Two techniques for fabricating dial 8 may be envisaged. The first technique consists in taking a transparent dial 8 which is then covered with a layer of paint except at the places where indices 12*a*-12*e* are arranged. The second technique consists in taking an opaque dial 8 in which shapes corresponding to indices 12*a*-12*e* are pierced. The pierced holes corresponding to indices 12*a*-12*e* will preferably be closed by means of small adhesive coupons 14 which will be bonded from underneath dial 8. These adhesive coupons 14 can be selected to be transparent or diffusing, white or coloured.

Figure 3:
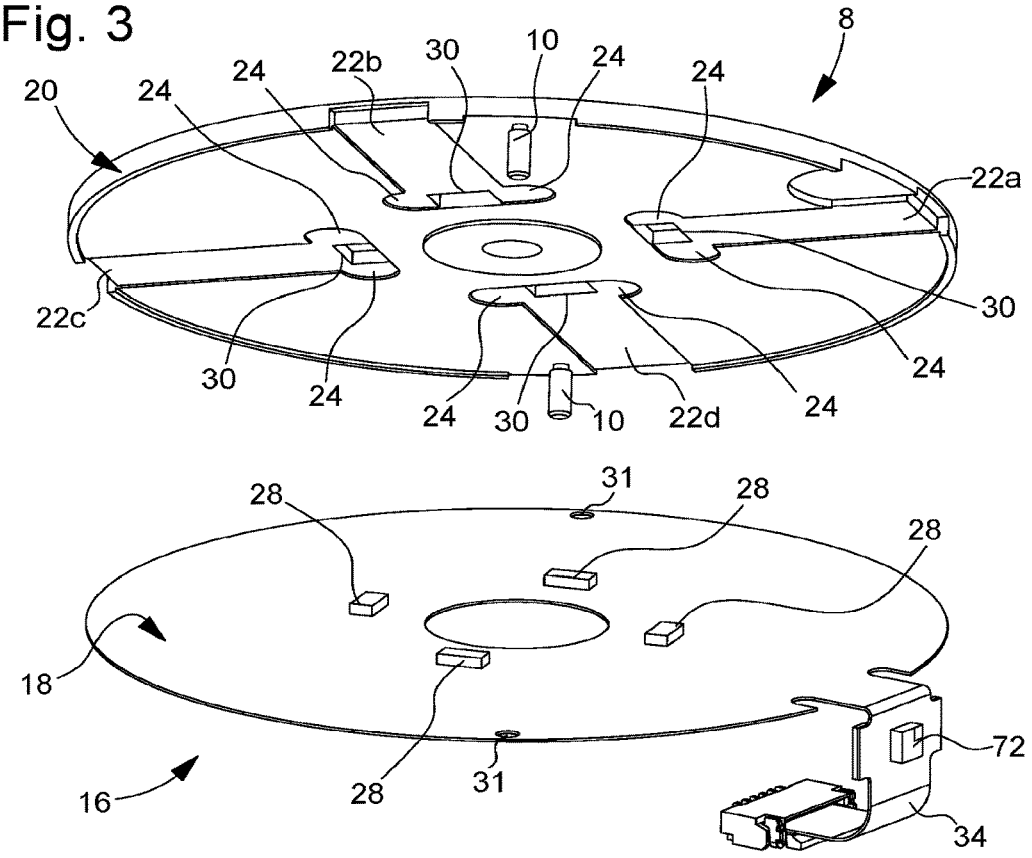
FIG. 3 is a perspective view, in an unassembled state, of the dial of FIG. 2 and of a first sheet on which are mounted light sources and corresponding light guides.

According to the invention (see FIG. 3), a first printed circuit sheet 16 of substantially circular profile and of slightly smaller diameter to that of dial 8 is bonded via its upper surface 18 onto the lower surface 20 of dial 8. One possible manufacturing technique consists in providing lower surface 20 of dial 8 with strips of double sided adhesive tape and then pressing first printed circuit sheet 16 onto dial 8.

Lower surface 20 of dial 8 against which the upper surface of first printed circuit sheet 16 will be pressed, is provided, at locations that will match indices 12*a*-12*e* arranged in dial 8, with four light guides 22*a*, 22*b*, 22*c* and 22*d* of generally rectangular shape and whose dimensions slightly exceed those of indices 12*a*-12*e*. As revealed by an examination of FIGS. 2 and 3, light guides 22*a*-22*d* are provided with lugs 24 to mount the guides underneath dial 8. In the example represented in the drawing, mounting lugs 24 are asymmetric, which provides a means of foolproofing preventing light guides 22*a*-22*d* from being mounted the wrong way round under dial 8. For the mounting of light guides 22*a*-22*d*, lower surface 20 of dial 8 is provided with recesses 23*a*-23*d* whose profile matches that of light guides 22*a*-22*d*. Light guides 22*a*-22*d* are bonded underneath dial 8 via their lugs 24. This ensures the presence of a thin layer of air between light guides 22*a*-22*d* and lower surface 20 of dial 8 at the places where light guides 22*a*-22*d* are not coated with adhesive, as a result of which the light will be propagated by total reflection inside light guides 22*a*-22*d*.

Upper surface 18 of first printed circuit sheet 16, via which the latter will be pressed against lower surface 20 of dial 8, is provided, at locations which will match light guides 22*a*, 22*b*, 22*c* and 22*d*, with light sources 28, for example of the light emitting diode type. These light sources 28 are disposed on upper surface 18 of first printed circuit sheet 16 so that, when first printed circuit sheet 16 is bonded to lower surface 20 of dial 8, light sources 28 are disposed facing the short sides 30 of light guides 22*a*-22*d* which are located opposite to the periphery of printed circuit sheet 16. These light sources 28 are optically coupled to light guides 22*a*-22*d* so that the light that they emit in a horizontal direction is propagated inside light guides 22*a*-22*d* by total reflection. To facilitate the positioning of first printed circuit sheet 16 relative to dial 18, first printed circuit sheet 16 is preferably pierced with holes 31 in which dial-feet 10 of dial 8 will engage.

It will be understood that if light sources 28 have a sufficiently wide angle of diffusion, it is possible to dispense with light guides 22*a*-22*d* and to place light sources 28 directly underneath indices 12*a*-12*e*. It is also possible to envisage using light sources 28 that illuminate vertically upwards and, if necessary, associating diffusing lenses therewith to illuminate a larger surface area. Light guides 22*a*-22*d* may be of the light diffusing type. In such case, the small adhesive coupons that close the pierced holes matching indices 12*a*-12*e* arranged in dial 8 may be transparent. The diffusing light guides have the drawback, however, of diffusing light in an isotropic manner; they therefore lack directivity, which may result in poor brightness of the indices. This is why it is preferred to use transparent light guides, for example made of poly(methyl methacrylate) or PMMA, and in which are structured light extractors, whose function is to extract, upwards towards the indices, the light injected into the light guides by light sources 28. In order to hide light guides 22*a*-22*d* and light sources 28 arranged underneath dial 8 from the user's view, and to prevent any risk of the user being able to see the light extractors with the naked eye, a problem known as "pixelation", transparent light guides may be combined with diffusing adhesive strips on which will be deposited a layer of transmissive paint whose function will be to hide light guides 22*a*-22*d* and the light sources arranged underneath dial 8 from the user's view.

The conductive paths (not shown) that allow light sources 28 to be connected to an electronic power and control assembly 32, which will be described below, all converge on a connecting tongue 34 provided at one location on the periphery of printed circuit sheet 16.

Figure 4:
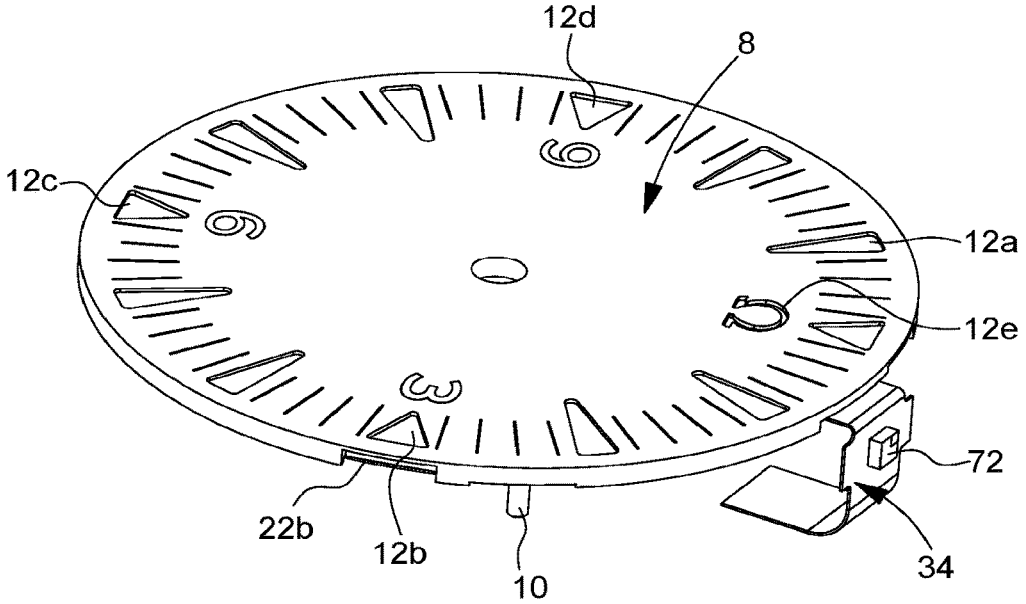
FIG. 4 is a perspective top view of the module formed by the dial, the light guides and the first printed circuit sheet.
Figure 5:
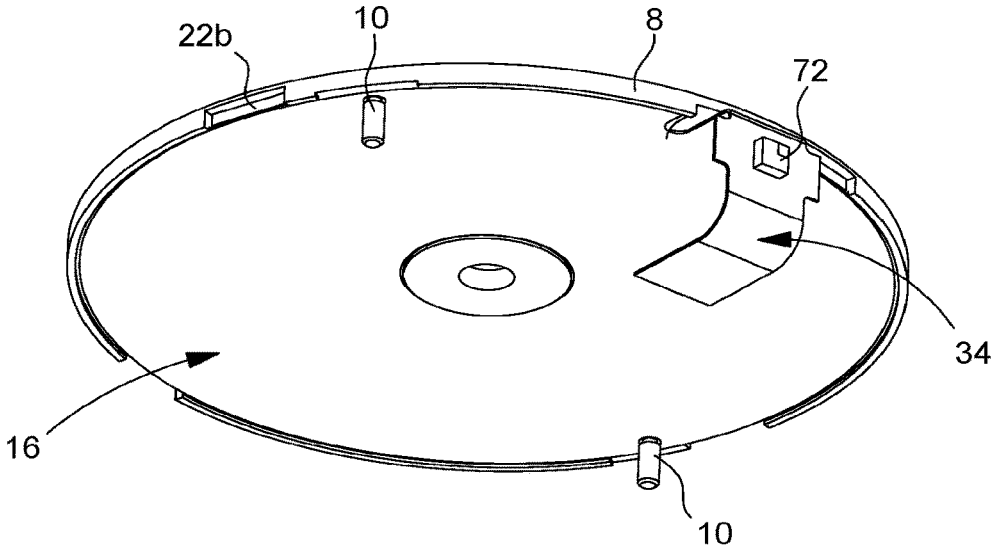
FIG. 5 is a perspective bottom view of the module formed by the dial, the light guides and the first printed circuit sheet.
Figure 6:
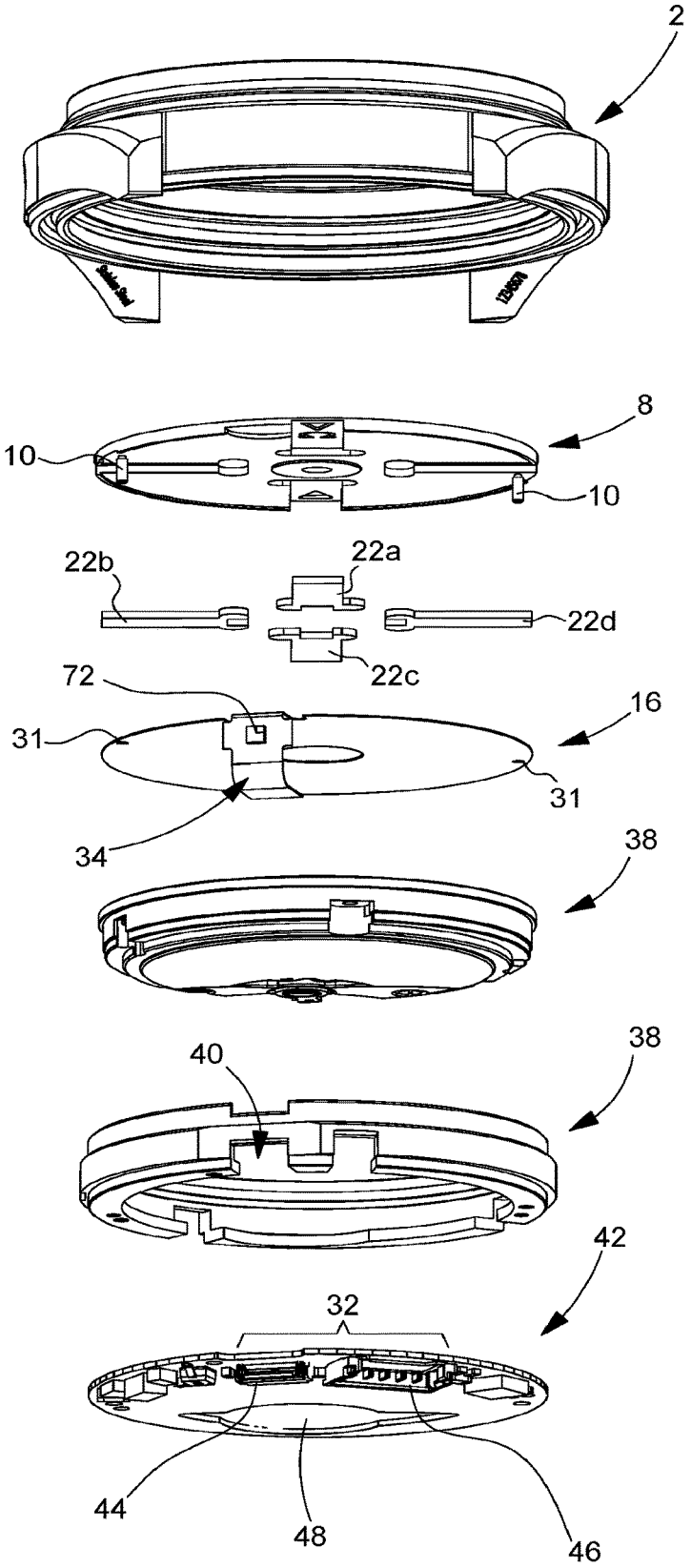
FIG. 6 is a perspective view, in an unassembled state, of the module formed by the dial, the light guides and the first printed circuit sheet disposed above a casing ring for a timepiece movement of the wristwatch according to the invention, with a second printed circuit sheet on which are arranged electronic components for powering and controlling the light sources being disposed underneath the casing ring.
Figure 7:
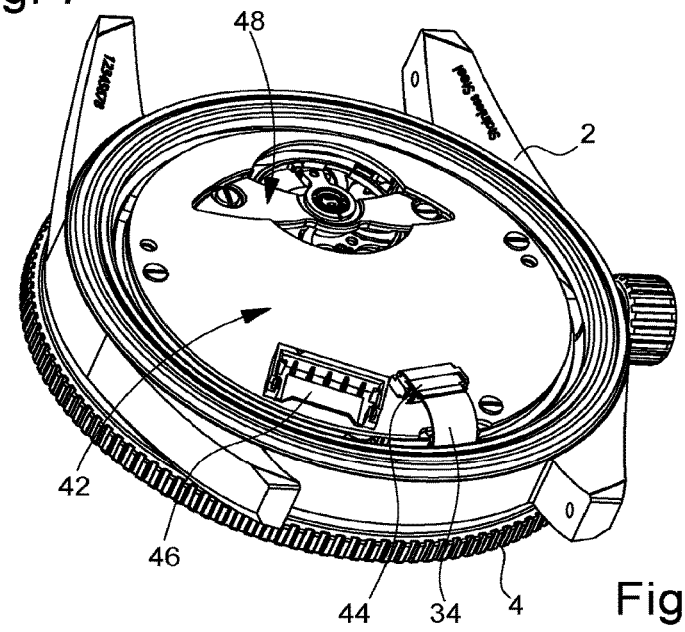
FIG. 7 is a bottom view of the second printed circuit sheet in which a cut-out is arranged to leave one part of the timepiece movement visible.

Once printed circuit sheet 16 is secured to lower surface 20 of dial 8 (FIGS. 4 and 5), the assembly thus obtained is disposed on a timepiece movement 36, then locked thereon by means of dial-feet 10 of dial 8 (FIGS. 6 and 7). The set of hands 6 is then pressed onto the pipe of timepiece movement 36. The resulting assembly is then advantageously housed inside a casing ring 38, after which connecting tongue 34 is bent at 90° and the free end thereof is passed through a hollow 40 provided in the peripheral side wall of casing ring 38. Finally, casing ring 38 is itself fixed by screws and clamps inside case middle 2.

Timepiece movement 36 may be of any type, for example purely mechanical or electromechanical. The invention is particularly advantageous in the case where the wristwatch is equipped with a purely mechanical movement, since it allows such a mechanical wristwatch to be combined with an electrical lighting function without having to make any modification to the mechanical movement.

A second printed circuit sheet 42, which carries electronic power and control assembly 32, is disposed underneath casing ring 38. This second printed circuit sheet 42 carries, in particular, a connector 44 in which is engaged connecting tongue 34 of first printed circuit sheet 16 and the various electronic components, notably a microprocessor circuit 46, necessary for the programming, the control and the electrical power management of light sources 28. It is thus seen that connecting tongue 34 can directly connect light sources 28, carried by first printed circuit sheet 16, to the electronic programming and electrical power management components 46, carried by second printed circuit sheet 42, by spanning timepiece movement 36 housed inside its casing ring 38. As a result of these features, it is possible to provide a purely mechanical watch with an electrical lighting device without having to modify movement 36. Connector 44 is, for example, of the zero insertion force (ZIF) type. As can be seen in the drawing, a cut-out 48 may be provided in second printed circuit sheet 42 to leave part of timepiece movement 36 visible.

Figure 8:
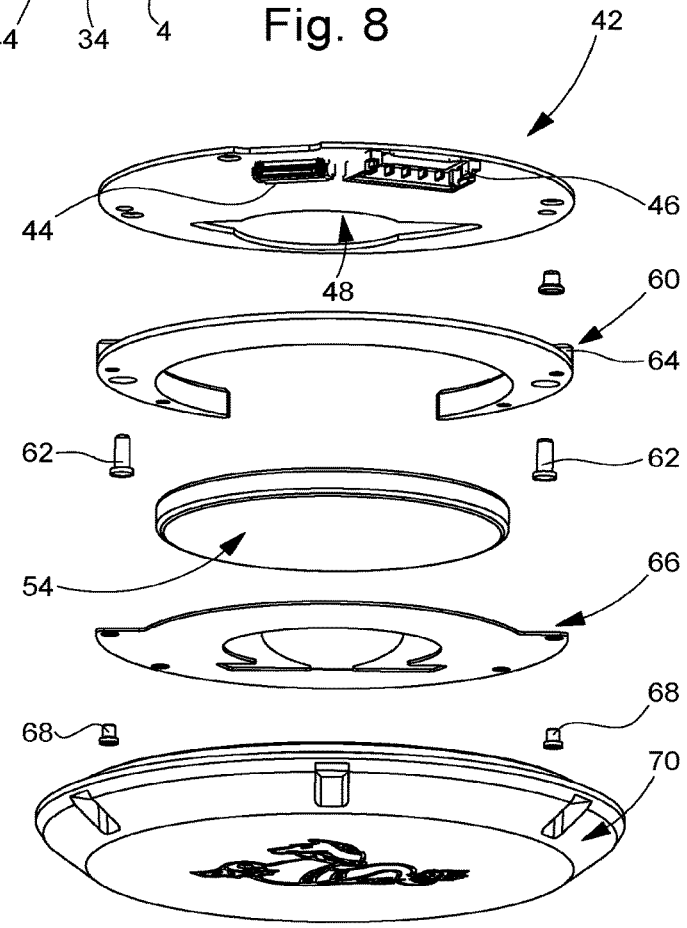
FIG. 8 is a perspective view, in an unassembled state, of the system for mounting an energy source underneath the second printed circuit sheet.
Figure 9:
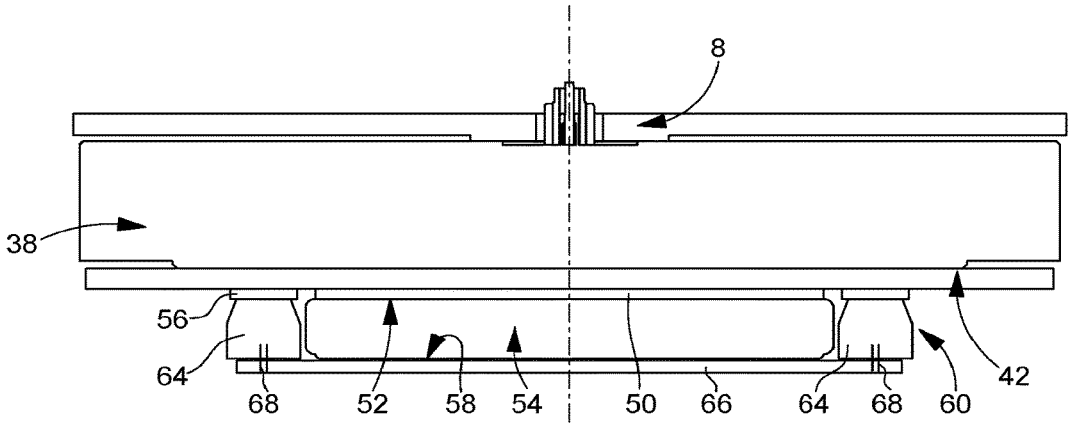
FIG. 9 is a vertical cross-section of the system for mounting the energy source illustrated in FIG. 8.
Figure 10:
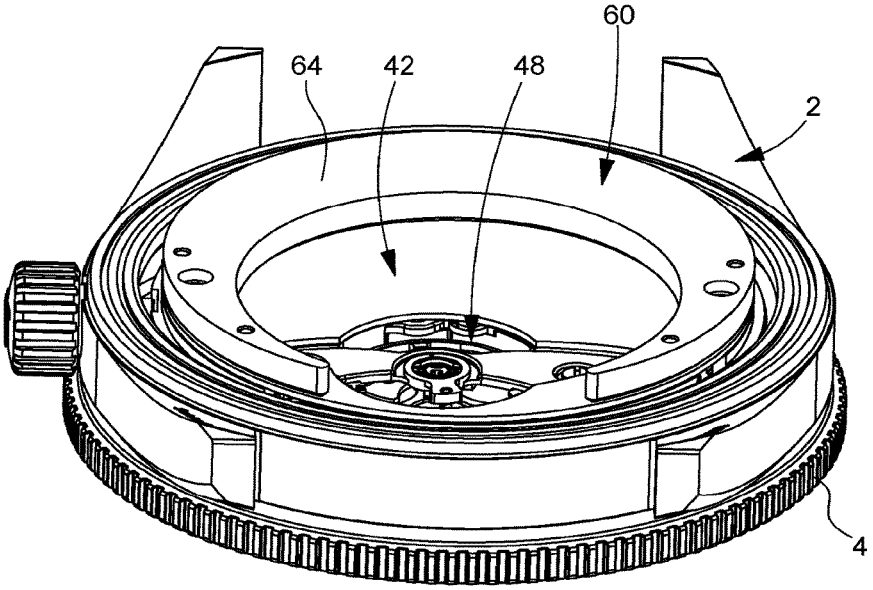
FIG. 10 shows the underside of the wristwatch with the fixing-clamp for the energy source in place.
Figure 11:
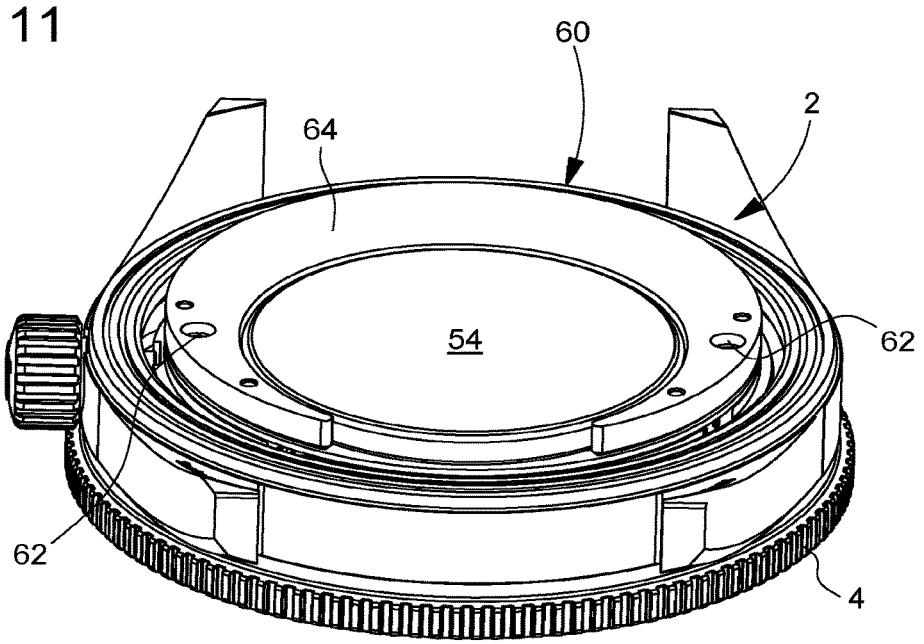
FIG. 11 is a similar view to that of FIG. 10, with the energy source set in place.
Figure 12:
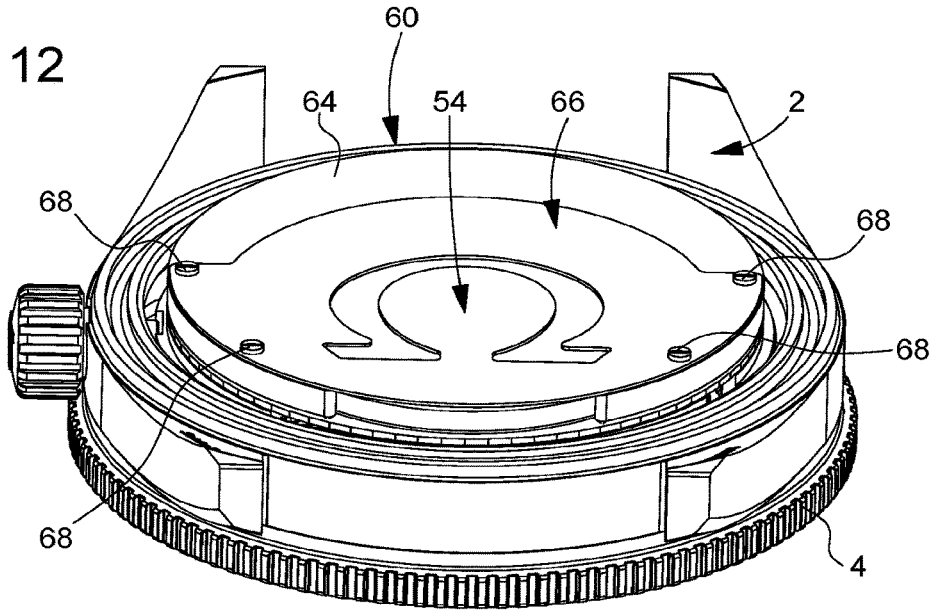
FIG. 12 is a similar view to that of FIG. 11, with the contact leaf set in place.

A first electrically conductive contact pad 50, for example in the form of a disc, is structured on the lower face of second printed circuit sheet 42 and is in direct contact, for example, with a negative terminal 52 of an electrical energy source 54, such as a rechargeable battery or accumulator (FIGS. 8 and 9). A second contact pad 56, for example of annular shape, is concentrically arranged around first contact pad 50 and is intended to be connected to a positive terminal 58 of electrical energy source 54. To this end, electrical energy source 54 is fixed underneath second printed circuit sheet 42 by means of an electrically conductive mounting clamp 60 which is, for example, immobilised by means of securing screw 62 (FIG. 10). This mounting clamp 60 is in contact with second contact pad 56 via a rim 64 in the arc of a circle, whose profile is identical to that of second contact pad 56 and whose height is equal to the thickness of electrical energy source 54. Finally, the electrical connection between electrical energy source 54 and second contact pad 56 is ensured by a contact leaf 66, which electrically connects positive terminal 58 of electrical energy source 54 and mounting clamp 60 to each other (FIGS. 11 and 12). This contact leaf 66 is, for example, immobilised on mounting clamp 60 by means of securing screw 68.

Finally, the assembly formed by dial 8, first printed circuit portion 16, timepiece movement 36, casing ring 38, second printed circuit sheet 42 and electrical energy source 54 is placed inside case middle 2 which is closed from underneath by means of a back cover 70.

Figure 13:
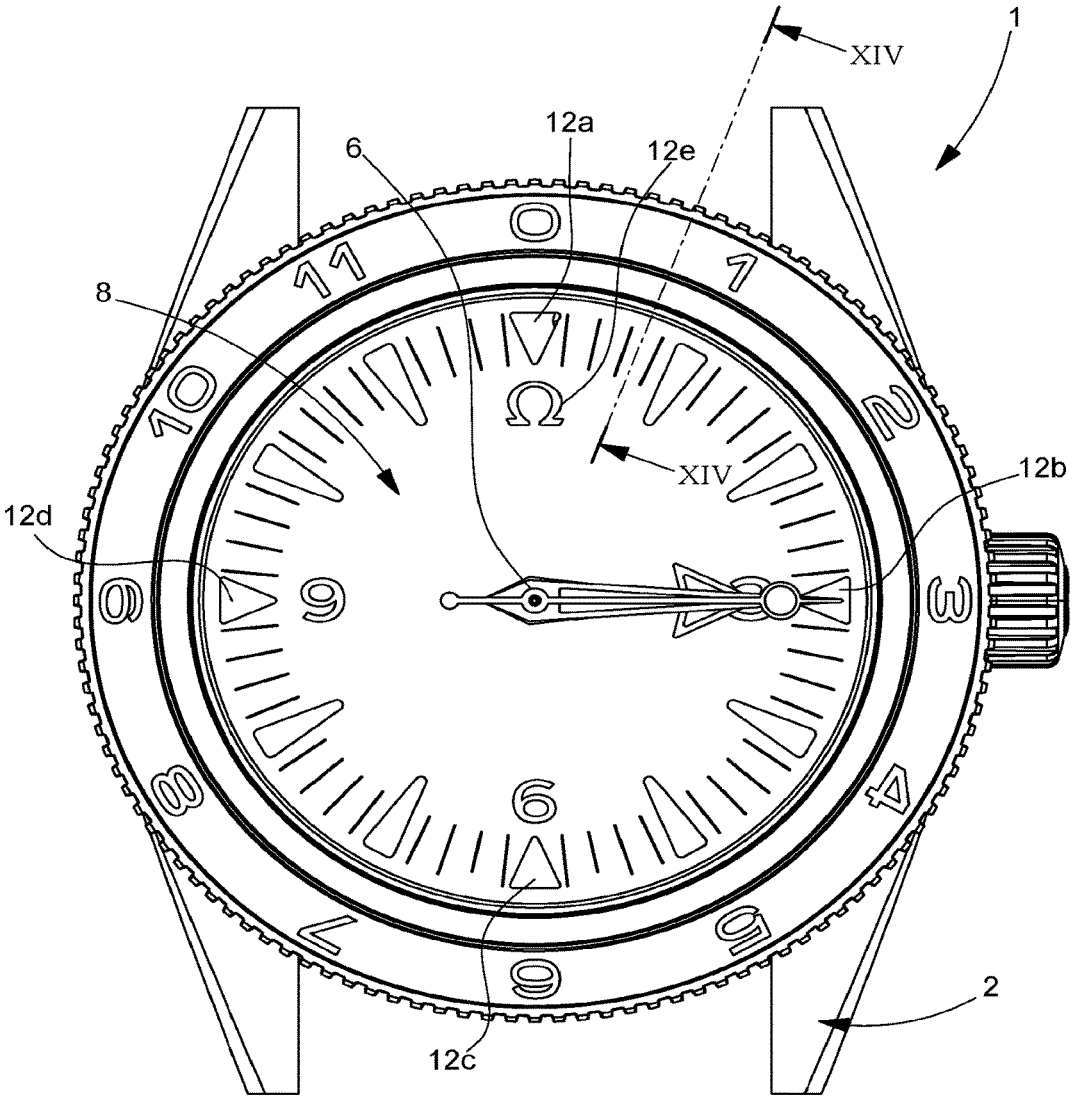
FIG. 13 is a top view of the wristwatch case according to the invention.
Figure 14:
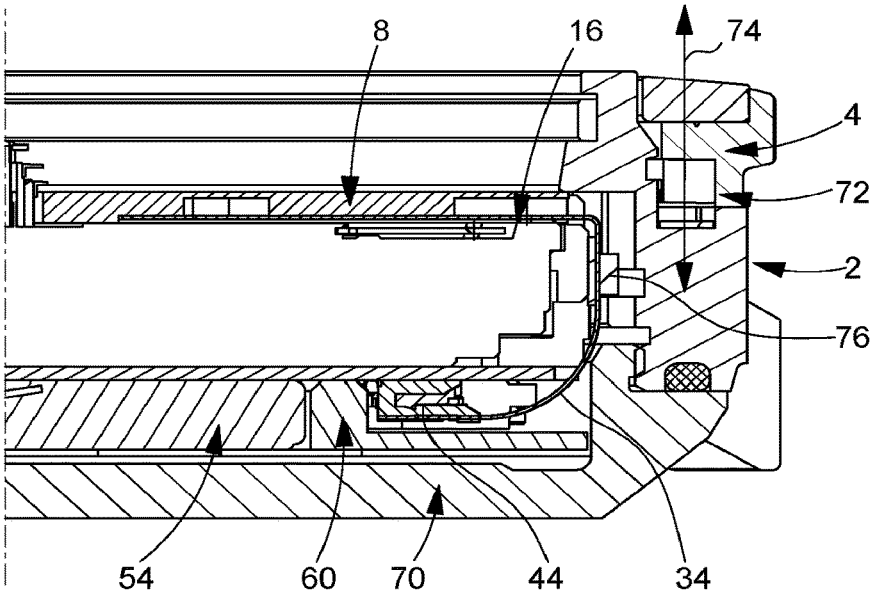
FIG. 14 is a cross-sectional view along the line XIV-XIV of FIG. 13 illustrating an activation component housed inside a rotating bezel and a detection component housed inside the wristwatch case according to the invention.

According to the invention, a component for activating the at least one light source 28 is housed inside rotating bezel 4 (FIGS. 13 and 14). This activation component is typically a bipolar magnet 72 with a vertically oriented direction of polarization 74. The presence of this bipolar magnet 72 is detected by a detection component, such as a magnetic sensor 76, housed inside wristwatch case 1, formed by case middle 2 closed by back cover 70. According to a preferred but non-limiting embodiment, magnetic sensor 76 is secured to connecting tongue 34. It is thus understood that it is the position of magnetic sensor 76 inside wristwatch case 1 which determines the position of rotating bezel 4, in which the presence of bipolar magnet 72 is detected by magnetic sensor 76. When the presence of bipolar magnet 72 is detected by magnetic sensor 76, i.e., in the present case, when bipolar magnet 72 is positioned above magnetic sensor 76, magnetic sensor 76 generates an electrical signal which will be addressed to microprocessor circuit 46. On reception of this electrical signal, microprocessor circuit 46 emits an electrical signal that activates the lighting of light source 28 for a determined period of time. An example of a magnetic sensor 76 well suited to the requirements of the invention is provided by the ADL-Series range of very low power digital sensors marketed by the American NVE Corporation. These digital sensors are of the magnetoresistive type and are devised to operate at low voltage and with extremely low currents. These digital sensors operate like magnetic "switches", their output passing to "1" when a magnetic field is applied, and returning to "0" when the magnetic field is removed. These magnetic "switches" include an element of the magnetoresistive-type sensitive to magnetic fields and a CMOS type signal processing device for converting the analogue signal produced by the sensitive element into a digital element.

Figure 15:
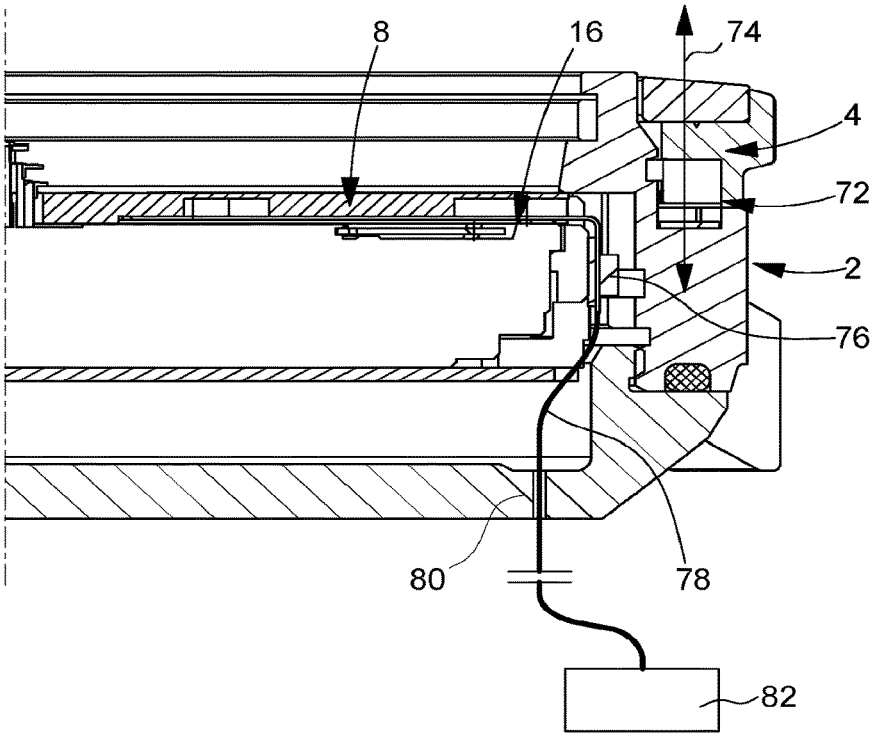
FIG. 15 illustrates a variant embodiment in which the light sources are operated from outside the wristwatch case by means of a wired connection which traverses a hole arranged in the back of the wristwatch case according to the invention.
Figure 16A:
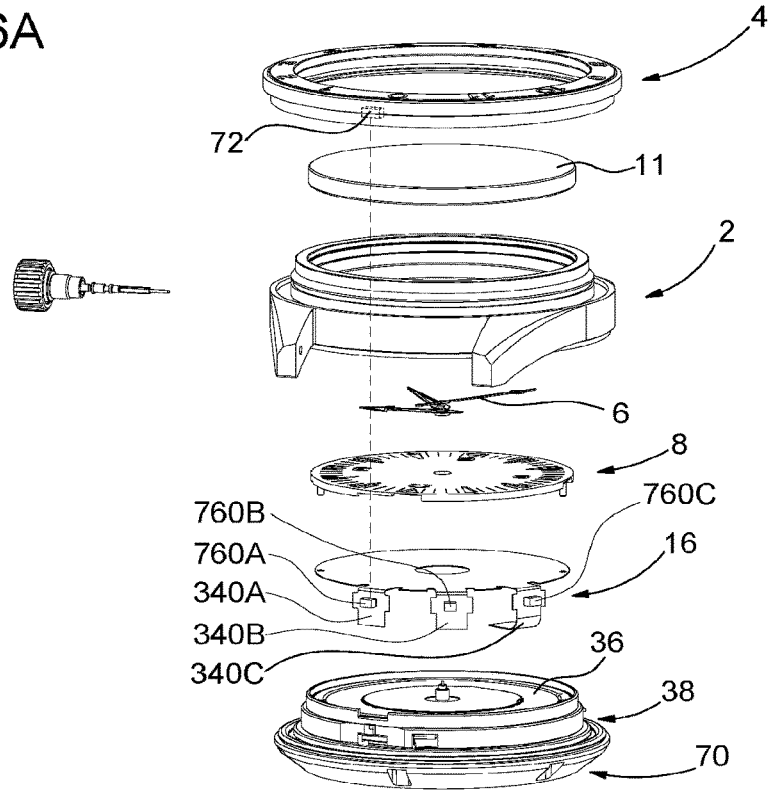
FIGS. 16A and 16B are schematic views of a variant embodiment in which the first printed circuit sheet carries several detection components to detect different positions of the rotating bezel and to control activation of the light sources in different manners.
Figure 16B:
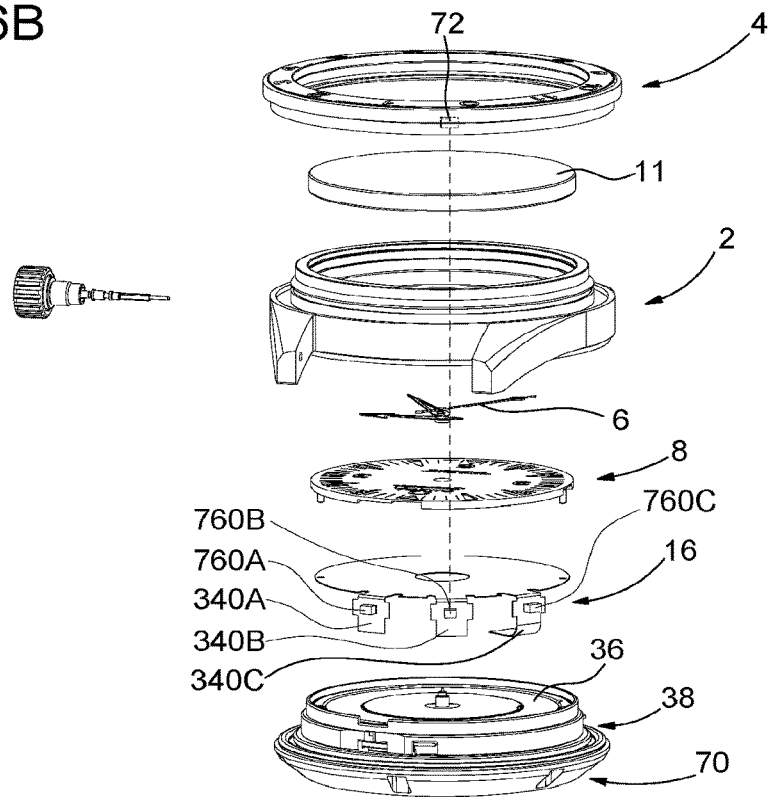

It goes without saying that this invention is not limited to the embodiment that has just been described and that various simple modifications and variants can be envisaged by those skilled in the art without departing from the scope of the invention as defined by the annexed claims. In particular, light sources 28 could be powered and controlled from the exterior of wristwatch case 1 of the invention by means of a wired connection 78, which traverses a hole 80 arranged in the back of the watch case and which connects light sources 28 to a power and control box 82 (FIG. 15). In order to detect several positions of rotating bezel 4, and to activate the lighting of light sources 28 in different manners, several connecting tongues 340A, 340B and 340C may be provided on the periphery of first printed circuit sheet 16, each of these connecting tongues 340A-340C carrying a detection component 760A-760C which detects the presence of activation component 72 in a corresponding determined position of rotating bezel 4 (see FIGS. 16A and 16B). More specifically, in FIG. 16A, rotating bezel 4 is in a first position in which the presence of activation component 72 is detected by a first detection component 760A, and in FIG. 16B, the presence of activation component 72 is detected by a second detection component 760B, different from the first. An examination of FIGS. 16A and 16B reveals that two of the three connecting tongues 340A and 340B are devoid of the pointed end via which they are normally inserted into a corresponding connector 44, only connecting tongue 340C being provided with such an end. By arranging for the signals produced by detection components 340A and 340B to be directed towards electronic power and control assembly 32 using connecting tongue 340C, such an embodiment eliminates the need for two connectors 44.

Many applications of the present invention may be envisaged. It is possible, for example, to envisage that electronic power and control assembly 32 includes a component generating an alarm signal (a sound or mechanical vibration) and which is provided with an electromagnetic antenna for near field communication. By placing rotating bezel 4 in a determined position in which the presence of activation component 72 will be detected by detection component 76, the alarm signal generator component may then be programmed, for example, with the aid of a mobile telephone as regards the day and alarm time. It is also possible to envisage that placing rotating bezel 4 in a determined position, in which the presence of activation component 72 will be detected by detection component 76, starts an information exchange, for example to make a payment or open a vehicle or house door, between a memory circuit housed inside the wristwatch case and equipped with an electromagnetic antenna for near field communication, and a remote reader.

LIST OF PARTS

Watch case 1
Case middle 2
Rotating bezel 4
Set of hands 6
Dial 8
Dial-feet 10
Crystal 11
Indices 12*a*, 12*b*, 12*c*, 12*d* and 12*e*
Adhesive strips 14
First printed circuit sheet 16
Upper surface 18
Lower surface 20
Light guides 22*a*, 22*b*, 22*c* and 22*d*
Recesses 23*a*-23*d*
Mounting lugs 24
Long sides 26
Light sources 28
Short sides 30
Holes 31
Electronic power and control assembly 32
Connecting tongue 34
Timepiece movement 36
Casing ring 38
Hollow 40
Second printed circuit sheet 42
Connector 44
Microprocessor circuit 46
Cut-out 48
First contact pad 50
Negative terminal 52
Electrical energy source 54
Second contact pad 56
Positive terminal 58
Mounting clamp 60
Securing screw 62
Rim 64
Contact leaf 66
Securing screw 68
Back cover 70
Activation component 72
Direction of polarization 74
Detection component 76
Wired connection 78
Hole 80
Electronic power and control box 82
Connecting tongues 340A-340C
Detection components 760A-760C

The invention claimed is:

1. A wristwatch comprising:
a watch case inside which is housed a timepiece movement;
a bezel mounted to rotate on the watch case; and
a dial including at least one luminous index;
wherein the luminous index is illuminated through the dial by at least one light source disposed underneath the dial and powered by an electrical energy source;
wherein an activation component for activating the light source is housed inside the rotating bezel and cooperates with a detection component housed inside the watch case;
wherein the activation component is configured such that, in a determined position of the rotating bezel, presence of the activation component is detected by the detection component;
wherein the detection component is configured to emit an electrical signal addressed to an electronic power and control assembly housed inside the watch case;
wherein the electronic power and control assembly is configured to emit in response to reception of the electrical signal emitted by the detection component an electrical signal that activates lighting of the light source for a determined period of time;
wherein a lower surface of the dial includes recesses and a light guide is arranged in each of the recesses;
wherein the at least one light source is mounted on an upper surface of a first printed circuit sheet disposed underneath the lower surface of the dial and positioned adjacent to the light guides;
wherein the first printed circuit sheet is disposed above the timepiece movement;
wherein a second printed circuit sheet that carries the electronic power and control assembly is disposed underneath the timepiece movement; and
wherein the light source carried by the first printed circuit sheet is electrically connected to the electronic power and control assembly by a connecting tongue.

2. The wristwatch according to claim 1, wherein the activation component is a bipolar magnet and wherein the detection component is a magnetic sensor.

3. The wristwatch according to claim 2, wherein the lower surface of the dial is provided at a location that corresponds to the at least one luminous index provided in the dial, with a light guide into which is injected the light produced by the light source.

4. The wristwatch according to claim 3, wherein the light guide is a diffusing light guide.

5. The wristwatch according to claim 3, wherein the light guide is transparent, and wherein light extractors, whose function is to extract upwards towards the luminous index the light injected by the light source, are structured in the light guide.

6. The wristwatch according to claim 1, wherein the lower surface of the dial is provided at a location that corresponds to the at least one luminous index provided in the dial, such that the light produced by the light source is injected into the light guide.

7. The wristwatch according to claim 6, wherein the light guide is a diffusing light guide.

8. The wristwatch according to claim 6, wherein the light guide is transparent, and wherein light extractors, whose function is to extract upwards towards the luminous index the light injected by the light source, are structured in the light guide.

9. The wristwatch according to claim 1, wherein the first printed circuit sheet is bonded via the upper surface thereof to the lower surface of the dial.

10. The wristwatch according to claim 1, wherein the connecting tongue is provided at a location on a periphery of the first printed circuit sheet and is inserted into a connector provided on the second printed circuit sheet.

11. The wristwatch according to claim 1, wherein the activation component is arranged on the connecting tongue.

12. The wristwatch according to claim 1, wherein a first electrically conductive contact pad is structured on a lower face of the second printed circuit sheet and is in direct contact with a negative terminal of an electrical energy source, wherein a second contact pad is connected to a positive terminal of the electrical energy source, wherein the electrical energy source is secured underneath the second printed circuit sheet by an electrically conductive mounting clamp in contact with the second contact pad, and wherein the second contact pad is connected to the positive terminal of the electrical energy source via a contact leaf.

13. The wristwatch according to claim 1, wherein the light source is powered and controlled from an exterior of the watch case by a wired connection that connects the light source to a power and control box.

14. The wristwatch according to claim 1, wherein each of the light guides includes mounting lugs that are bonded to the lower surface of the dial to mount the light guides to the dial.

15. The wristwatch according to claim 1, wherein each of the light guides includes two mounting lugs positioned on opposite sides of an inner end of the light guide, and the mounting lugs are symmetrical.

16. The wristwatch according to claim 1, wherein dial feet extend down from the lower surface of the dial and engage with holes pierced in the first printed circuit sheet.

17. A wristwatch comprising:

a watch case inside which is housed a timepiece movement;

a bezel mounted to rotate on the watch case; and a dial including at least one luminous index;

wherein the luminous index is illuminated through the dial by at least one light source disposed underneath the dial and powered by an electrical energy source;

wherein an activation component for activating the light source is housed inside the rotating bezel and cooperates with a detection component housed inside the watch case;

wherein the activation component is configured such that, in a determined position of the rotating bezel, presence of the activation component is detected by the detection component;

wherein the detection component is configured to emit an electrical signal addressed to an electronic power and control assembly housed inside the watch case;

wherein the electronic power and control assembly is configured to emit in response to reception of the electrical signal emitted by the detection component an electrical signal that activates lighting of the light source for a determined period of time;

wherein the at least one light source is mounted on an upper surface of a first printed circuit sheet disposed underneath a lower surface of the dial;

wherein the first printed circuit sheet is disposed above the timepiece movement;

wherein a second printed circuit sheet that carries the electronic power and control assembly is disposed underneath the timepiece movement;

wherein the light source carried by the first printed circuit sheet is electrically connected to the electronic power and control assembly by a connecting tongue;

wherein a first electrically conductive contact pad is structured on a lower face of the second printed circuit sheet and is in direct contact with a negative terminal of an electrical energy source;

wherein a second contact pad is connected to a positive terminal of the electrical energy source;

wherein the electrical energy source is secured underneath the second printed circuit sheet by an electrically conductive mounting clamp in contact with the second contact pad; and wherein the second contact pad is connected to the positive terminal of the electrical energy source via a contact leaf.

* * * * *